United States Patent [19]

Sundström et al.

[11] Patent Number: 4,613,108

[45] Date of Patent: Sep. 23, 1986

[54] APPLIANCE FOR HANGING OBJECTS ON WALLS

[76] Inventors: Fred Sundström, Rind 2466; Kent Sundström, Fanbyn 1445, both of Gällö, Sweden

[21] Appl. No.: 694,673

[22] PCT Filed: May 16, 1984

[86] PCT No.: PCT/SE84/00184

§ 371 Date: Jan. 14, 1985

§ 102(e) Date: Jan. 14, 1985

[87] PCT Pub. No.: WO84/04661

PCT Pub. Date: Dec. 6, 1984

[30] Foreign Application Priority Data

Jun. 2, 1983 [SE] Sweden ..... 8303114

[51] Int. Cl.[4] ..... A47G 1/16

[52] U.S. Cl. ..... 248/497; 40/10 R; 40/17; 248/216.1; 248/217.3; 248/218.3

[58] Field of Search ..... 248/497, 217.2, 217.1, 248/216.1, 225.2, 301, 304, 217.3, 218.3, 216.4, 222.2; 40/10 R, 12, 17

[56] References Cited

U.S. PATENT DOCUMENTS

| | | | |
|---|---|---|---|
| 514,222 | 2/1894 | Hall | 248/216.1 X |
| 841,550 | 1/1907 | Leonard | 248/216.1 |
| 1,616,957 | 2/1927 | Honigbaum | 248/217.3 |
| 1,999,575 | 4/1935 | Reuter et al. | 248/497 |
| 2,040,750 | 5/1936 | Long | 248/300 X |
| 3,305,984 | 2/1967 | Borcuk | 248/217.1 X |
| 4,040,149 | 8/1977 | Einhorn | 248/497 X |
| 4,560,126 | 12/1985 | Judkins et al. | 248/72 |

FOREIGN PATENT DOCUMENTS

| | | | |
|---|---|---|---|
| 483240 | 9/1929 | Fed. Rep. of Germany . | |
| 497882 | 12/1970 | Switzerland . | |
| 0291964 | 6/1928 | United Kingdom | 248/497 |

*Primary Examiner*—Ramon O. Ramirez

*Attorney, Agent, or Firm*—Larson & Taylor

[57] ABSTRACT

An appliance for hanging pictures or the like on walls, especially walls made up of gypsum wallboards, comprises a fixing part insertable in the wall and a suspension part, for instance in the form of a hook, accessible from outside and adapted to receive the picture to be hung. According to the invention, the fixing part consists of a preferably extremely thin plate adapted to be driven into the wall with its plate lying or oriented substantially horizontally.

4 Claims, 2 Drawing Figures

APPLIANCE FOR HANGING OBJECTS ON WALLS

TECHNICAL FIELD OF THE INVENTION

The present invention relates to an appliance for hanging objects, for instance pictures, on walls, especially gypsum wallboards, comprising a fixing part insertable in the wall and consisting of or comprising a preferably extremely thin plate adapted to be driven into the wall with its plane lying or oriented substantially horizontally, and a suspension part, for instance a hook, which is accessible from outside and adapted to receive the object to be hung.

STATE OF THE ART

A suspension appliance of the above-mentioned type is previously known from Swiss patent No. 497882 and German patent No. 483240. In these prior art devices, use is however made of single plates which are adapted to penetrate into the wall, which means that the plate and, hence, the entire appliance may easily be unintentionally extracted from the wall.

BRIEF DESCRIPTION OF THE INVENTIVE CONCEPT

The present invention aims at eliminating the above-mentioned drawback by providing a suspension appliance which will steadily remain in the wall when unintentionally actuated. According to the invention, this is achieved in that the appliance, in addition to said fixing plate, has at least one or suitably two tongues which are narrower than the plate and adapted to be driven into the wall concurrently with the plate, although at an angle which slightly deviates from the angle at which the plate is driven in.

DETAILED DESCRIPTION OF A PREFERRED EMBODIMENT OF THE INVENTION

Figure 1:
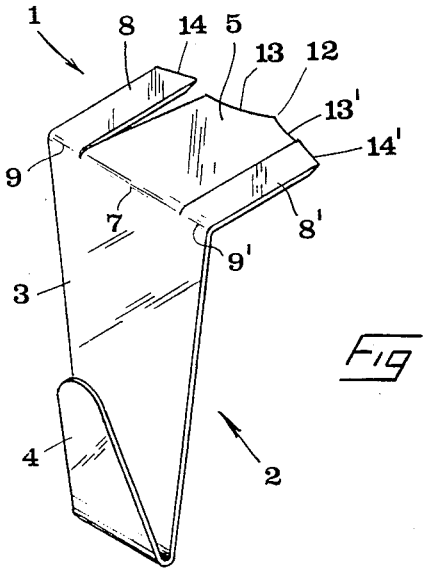
FIG. 1 is a perspective view of the suspension appliance according to the invention and FIG. 2 is a cross-section of a portion of a gypsum wallboard to which said appliance has been secured.
Figure 2:
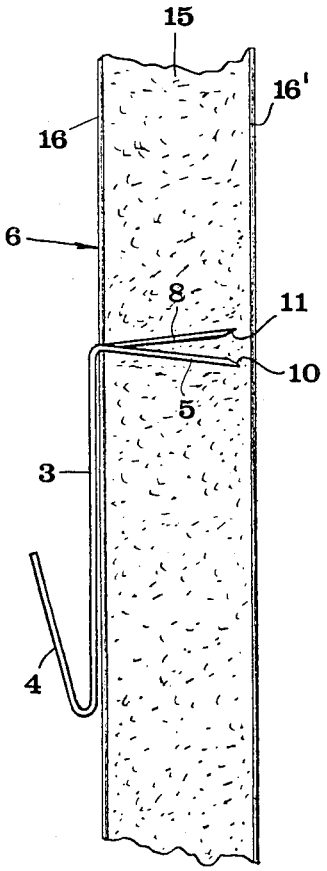

In FIG. 1, there is shown a suspension appliance which comprises a fixing part generally designated 1 and a suspension part generally designated 2. In the illustrated Example, the suspension part 2 is in the form of a hook consisting of a substantially planar web 3 intended to bear on the wall to which the appliance is secured, and of a hook-forming portion 4 formed by bending the lower portion of a web 3. Both the web 3 and the hook portion 4 are here assumed to be made of thin sheet metal. A fixing plate 5 is formed integral with the web 3 and intended to be driven into the gypsum wallboard 6 in FIG. 2. More precisely, the plate 5 is bent at an angle to the web portion 3 along a bending line intimated at 7. In the illustrated embodiment, there are also provided on either side of the plate 5 two tongues 8, 8' which, like the plate 5, are formed integral with the web portion 3 by being bent along the lines 9, 9'. In its unactuated state shown in FIG. 1, the tongues 8 are bent at an angle of approximately 90° to the plane of the web portion 3 while the plate 5 makes an angle with the web portion 3 that is slightly smaller than 90°, for instance 87°–89°. This means that the fixing plate and the tongues make between them a certain, small angle, for instance 1°–3°, diverging from the bending lines 7, 9 towards the free ends of the plate and the tongues. Further, it should be noted (see FIG. 2) that both the plate 5 and the tongues 8, 8' at their free ends have bevelled surfaces 10 and 11, respectively, which terminate in an extremely fine tip at the extreme end of the plate and the tongue. More precisely, the plate 5 is bevelled such that the surface 10 is directed obliquely upwardly whereas the tongues 8 are bevelled such that the surfaces 11 are directed obliquely downwardly. The combination of these bevelled surfaces 10, 11 and the above-mentioned initially existing angular deviation of the plate 5 with respect to the tongues 8, 8' entail that the relatively narrow tongues will tend to move obliquely upwardly in the gypsum material while the plate 5 moves obliquely downwardly when the fixing part 1 is driven into the gypsum wallboard, as shown in FIG. 2. In FIG. 2, the angle between the plate and the tongues is slightly exaggerated. However, even a very small angular deviation between the plate and the tongues will efficiently counteract any unintentional extraction of the fixing part 1 from the gypsum wallboard after completed application.

It further appears from FIG. 1 how the plate 5 at its free end, which first penetrates into the gypsum wallboard, has a pointed tip 12. From this tip, the front edge of the plate extends in a substantially V-shaped fashion along slightly arcuate edge portions 13, 13' to the two lateral edges of the plate. Similarly, the tongues 8, 8' are obliquely cut at 14 so as to form a pointed tip which readily cuts through the material of the gypsum wallboard.

Reference is again made to FIG. 2 showing how the gypsum wallboard 6 in a per se known manner is made up of a core 15 of gypsum and of paper or board layers 16, 16' provided on either side of the core. According to a special feature of the invention, the length or depth of penetration of the fixing plate 5 is slightly less than the total thickness of the paper layer 16 and the core 15. Hence, when driven into the gypsum wallboard, the fixing plate 5, like the tongues 8, 8', will penetrate the first paper layer 16 and a major portion of the core 15, however without reaching the second paper layer 16'. Since neither the fixing plate nor the tongues reach the second paper layer 16', this will not be weakened, even locally. Also, it is ensured that the fixing plate and the tongues will not affect for instance a moisture barrier in the form of a plastic sheeting, if such a moisture barrier is provided behind the gypsum wallboard.

The length of the plate 5 may in principle be substantially equal to the width of the plate. In actual practice, the width of the fixing plate may advantageously amount to 10–15 mm and, thus, the length or depth of penetration will be equally dimensioned. On the other hand, the tongues 8, 8' are considerably narrower than the plate 5. In practice, the tongues may have a width of 1–4, preferably 2–3 mm. The thickness of the fixing plate or the piece of sheet metal from which it is made may in practice amount to 0.2–1.0, suitably 0.3–0.6 mm.

The manufacture of the suspension appliance described above will be extremely simple in so far as both the suspension part 2 and the fixing part 1 consisting of the plate 5 and the tongues 8, 8' can be punched out as a single piece from sheet metal and thereafter be bent by uncomplicated means so as to assume the shape shown in FIG. 1. Further, the use of the suspension appliance is extremely simple since driving in the fixing part 1 into the wallboard or the wall panel merely requires a hammer or the like. Tests have shown that the suspension appliance according to the invention will safely remain in the wallboard once driven in and, owing to the large surface extent primarily of the plate 5, the appliance possesses a very good load bearing capacity. Thus, objects of a weight of 15 kg have been suspended from the appliance without any tendency to deterioration of the material in a gypsum wallboard in the region of the appliance.

POSSIBLE MODIFICATIONS OF THE INVENTION

It goes without saying that the invention is not restricted only to the embodiment described above and shown in the drawings. Thus, it is conceivable, instead of precisely two narrow tongues on either side of a wide fixing plate, to use only one such tongue. Further, it is possible to provide one tongue surrounded by two wider fixing plates.

Also, it is conceivable to use the appliance according to the invention in connection with wall panels or materials other than gypsum wallboards. It should also be pointed out that the suspension part which is connected to the fixing part or plate need not necessarily be in the form of precisely a hook. Thus, a projection of any suitable shape may protrude from the web 3, provided the projection is capable of retaining for instance the wire of a picture, or any other suitable means for suspending the object in question. It should be pointed out in particular that the suspension part may be a clip or a clamp for snapping fast electric lines. For this application, the clip is suitably directly connected to the suspension part. In order to achieve the desired divergence between the fixing plate 5 and the tongues 8, 8', it is not necessary that the plate and the tongues diverge already in the unactuated state. Thus, it is conceivable to make the appliance such that the plate and the tongues are contained in the same plane, the bevelled surfaces 10, 11 alone ensuring that the plate and the tongues tend to diverge as the appliance is driven into the gypsum wallboard. On the other hand, the bevelled surfaces 10, 11 may be completely dispensed with if the plate and the tongues are bent so as to diverge slightly already before the appliance is driven into the gypsum wallboard. Finally, it should be pointed out that the fixing plate 5 need not necessarily be driven into the wallboard in such a manner that it is positioned exactly horizontally. The essential thing thus is that the plate is lying so as to offer a considerable contact surface to the underlying gypsum material.

We claim:

1. An applicance for hanging objects, such as pictures, on walls, especially gypsum wall boards, comprising a fixing part insertable in the wall and comprising an extremely thin plate adapted to be driven into the wall with its plane lying substantially horizontally; a suspension part adapted to function as a hook with its plane lying substantially vertically which is accessible from outside the wall and is adapted to receive the object to be suspended, and two tongues, one on each side of said thin plate, each of which tongues are narrower than said plate and are structured to be driven into the wall concurrently with the plate but at an angle which slightly deviates from the angle at which the plate is driven in, said tongues constituting a means for counteracting unintentional extraction of the plate from the wall after the appliance has been fixed thereto, said thin plate and said tongues, in the unactuated state prior to insertion in the wall, forming a small angle with each other, which diverges in the direction of the free ends of the plate and the tongues.

2. An appliance according to claim 1, said small angle being between 1° and 3°.

3. An appliance according to claim 2, wherein the plate and the tongue, at their free ends, have bevelled surfaces which form a divergent angle with each other.

4. An appliance according to claim 1, in combination with a gypsum wall board into which the plate and tongues are inserted, which gypsum wall board has a gypsum core and paper layers on both sides thereof, wherein the depth of penetration of the plate into the gypsum wall board is slightly less than the total thickness of one of the paper layers and a gypsum core, such that the plate, when inserted into the wall, is free of engagement with the paper layer on the opposite side of the gypsum core.

* * * * *